US006882265B2

(12) United States Patent
Taguchi et al.

(10) Patent No.: US 6,882,265 B2
(45) Date of Patent: Apr. 19, 2005

(54) RESISTOR SUBSTRATE WITH RESISTOR LAYER AND ELECTRODE LAYER AND MANUFACTURING METHOD THEREOF

(75) Inventors: Yoshihiro Taguchi, Miyagi-ken (JP); Shunetsu Satou, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/617,622

(22) Filed: Jul. 10, 2003

(65) Prior Publication Data

US 2004/0012478 A1 Jan. 22, 2004

(30) Foreign Application Priority Data

Jul. 22, 2002 (JP) ..... 2002-212686

(51) Int. Cl.[7] ..... H01C 1/012

(52) U.S. Cl. ..... 338/309; 338/162; 338/176; 338/307

(58) Field of Search ..... 338/309, 176, 338/162, 307

(56) References Cited

U.S. PATENT DOCUMENTS 5,781,100 A 7/1998 Komatsu
5,920,454 A * 7/1999 Nomura et al. ..... 361/313
6,275,140 B1 * 8/2001 Asano ..... 338/162

* cited by examiner

*Primary Examiner*—Karl D. Easthom
(74) *Attorney, Agent, or Firm*—Beyer Weaver & Thomas LLP

(57) ABSTRACT

On a surface of a transfer sheet, a resistor paste is first patterned, and a binder resin thereof is then heat-cured to form resistor layers. Next, an electrode paste containing a binder resin, which has a thermosetting temperature lower than a thermosetting temperature and a glass transition temperature of the binder resin of the resistor layers, is patterned on surfaces of the resistor layers and is then heat-cured, thereby forming electrode layers. By the steps described above, powdered silver contained in the electrode layers is unlikely to ooze into the resistor layers.

5 Claims, 3 Drawing Sheets

RESISTOR SUBSTRATE WITH RESISTOR LAYER AND ELECTRODE LAYER AND MANUFACTURING METHOD THEREOF

BACKGROUND OF THE INVENTION

1. Field of the Invention

The present invention relates to resistor substrates for use in variable resistors and the like, and more particularly, relates to a resistor substrate and a manufacturing method thereof, the resistor substrate having a resistor layer embedded therein so that a surface thereof is exposed.

2. Description of the Related Art

In a related resistor substrate, a resistor layer having a predetermined pattern is provided on a surface of a molded base, and electrode layers are provided under two end portions of this resistor layer. In the case of a variable resistor, terminals are connected with the respective electrode layers, a sliding contact is provided which slides on a surface of the resistor layer located between the electrode layers, and the change in voltage can be detected between each terminal and the sliding contact in accordance with a sliding position thereof.

The related resistor substrate as described above is generally manufactured by the following steps. In a first step, a resistor paste is formed by mixing carbon black, pulverized carbon fiber, and a thermosetting binder resin such as a polyimide resin with a solvent, and this resistor paste is screen-printed on a transfer sheet formed of brass.

In a second step, the resistor paste is dried, for example, at 200° C. for approximately 30 minutes, thereby removing the solvent. In addition, on the resistor paste thus dried, the steps of screen printing and drying described above are repeatedly performed, thereby obtaining a resistor layer composed of at least two films each formed of the dried resistor paste.

In a third step, an electrode paste formed of a thermosetting binder resin and powdered silver dispersed in a solvent is screen-printed on the resistor layer and is then dried, for example, at 200° C. for 30 minutes, followed by further drying at 260° C. for approximately 30 minutes, so that the solvent is removed.

In addition, in the third step, heating is performed, for example, at 380° C. for approximately 70 minutes so that the binder resin used for the resistor paste and the binder resin used for the electrode paste are simultaneously heat-cured, thereby forming the resistor layer in which the carbon is dispersed in the resin and the electrode layers in which the powdered silver is dispersed in the resin.

In a fourth step, the transfer sheet provided with the resistor layer and the electrode layers formed in that order is placed in a mold, and after an epoxy resin or the like is injected into a cavity of the mold and is then cooled, the transfer sheet is removed.

Accordingly, at the surface of the substrate, the resistor layer is exposed, and the electrode layers are disposed under this resistor layer, so that the resistor layer and electrode layers are formed in the substrate.

However, in the resistor substrate manufactured by the related method described above, the powdered metal, that is, the powdered silver, dispersed in the electrode layers is likely to diffuse into the resistor layer, and the powdered silver is likely to ooze to the surface of the resistor layer.

The reason for this is that, in the related manufacturing method, since after the resistor layer and the electrode layers are patterned, the binder resins of both types of layers are simultaneously heat-cured by the heating described above, the powdered silver in the electrode layers is liable to ooze into the resistor layer when the resins are softened during the step in which the binder resins are cured. In particular, since the same binder resin has been used for the resistor layer and the electrode layers, the resin in both types of layers are simultaneously softened in the heating step, and at this stage, the powdered metal (powdered silver) in the electrode layers is likely to ooze into the resistor layer.

In addition, when the powdered silver used as the powdered metal oozes to the surface of the resistor layer, the silver may be corroded (sulfurated or the like), or migration thereof may occur to cause short-circuiting between adjacent patterns.

In addition, in a variable resistor, the change in resistance is detected when a sliding contact slides on a surface of a resistor surface located between electrode layers; however, while sliding, the sliding contact may slide on a region (multilayer pattern) in which the resistor layer is formed on the electrode layer in some cases. When the powdered silver oozes into the resistor layer in this region as described above, since the hardness of silver is lower than that of carbon particles (particularly, carbon fiber), the strength of the resistor layer in that region is decreased, and as a result, the resistor layer is liable to be worn by the sliding movement of the sliding contact.

In order to suppress the exposure of the powdered silver at the surface of the resistor layer, as described in the second step, the pattern printing of the resistor paste and the drying thereof are repeated at least twice in the past so as to increase the thickness of the resistor layer. However, in this case, the number of the pattern printing of the resistor paste is increased, and the productivity is decreased, resulting in high manufacturing cost. In addition, even when the thickness of the resistor layer is increased, it has been difficult to substantially prevent the powdered metal (powdered silver) from oozing into the resistor layer during heat-curing.

SUMMARY OF THE INVENTION

Accordingly, in order to solve the problem described above, an object of the present invention is to provide a resistor substrate and a manufacturing method thereof, the resistor substrate capable of preventing a powdered metal dispersed in an electrode layer from oozing into a resistor layer, the method capable of increasing the productivity.

In accordance with one aspect of the present invention, a resistor substrate comprises: a resistor layer containing a powdered conductive material which is dispersed in a heat-cured resin; and an electrode layer containing a powdered metal which is dispersed in a heat-cured resin, in which the resistor layer is exposed at the topmost surface of the substrate, the electrode layer is provided under the resistor layer, and the resistor layer and the electrode layer are supported by the substrate. In the resistor substrate described above, the resin of the electrode layer has a thermosetting temperature lower than that of the resin of the resistor layer.

In the resistor substrate described above, since the thermosetting temperature of the binder resin of the electrode layer is decreased, for example, after the binder resin of the resistor layer is first heat-cured, when the electrode layer is formed thereon, the resistor layer is not softened although the binder resin of the electrode layer is heat-cured. Hence, the powdered metal contained in the electrode layer is unlikely to ooze into the resistor layer.

In addition, even when a manufacturing method is used similar to that performed in the past, in which the binder resin of the resistor layer and the binder resin of the electrode layer are simultaneously heat-cured, since the thermosetting temperatures thereof are different from each other, the electrode layer is first cured in a heating step and the resistor layer is then cured, and hence the powdered metal can also be easily prevented from oozing into the resistor layer thereby.

In addition, the powdered metal may comprise powdered silver, the powdered conductive material may comprise powdered carbon, and the electrode layer is preferably covered with the resistor layer so that the electrode layer is not exposed at the surface of the substrate.

As described above, in order to prevent the powdered metal from oozing, the thermosetting temperature of the resin of the resistor layer is preferably different from that of the resin of the electrode layer by 30° C. or more.

In addition, in the case in which the binder resin of the resistor layer is first heat-cured, and the binder resin of the electrode layer is then heat-cured, in order to prevent the resistor layer from being softened when the electrode layer is heat-cured, the thermosetting temperature of the resin of the electrode layer is preferably lower than a glass transition temperature of the resin of the resistor layer.

As the combinations of the resins described above, for example, the resin of the resistor layer is preferably at least one selected from the group consisting of a thermosetting polyimide, a thermosetting poly(ether ketone), and a thermosetting bismaleimide, and the resin of the electrode layer is preferably at least one selected from the group consisting of a phenolic resin, an epoxy resin, and a melamine resin.

In addition, the resistor substrate of the present invention may further comprise a terminal connected to the electrode layer. The terminal is connected to an opposite surface of the electrode layer from that facing the resistor layer, the connection part between the electrode layer and the terminal is placed in the substrate, and hence the terminal is fixed to the substrate. Furthermore, the resistor substrate can be used to form a variable resistor in which a conductive sliding contact slides on the surface of the resistor layer.

In addition, in accordance with another aspect of the present invention, a method for manufacturing a resistor substrate comprises the following steps.

The steps mentioned above are: step (1) of forming a pattern of a resistor paste on a transfer sheet, the resistor paste containing a powdered conductive material which is dispersed in a first binder resin dissolved in a solvent, then removing the solvent, and forming a resistor layer by heat-curing of the first binder resin; step (2) of forming a pattern of an electrode paste on the resistor layer, the electrode paste containing a powdered metal which is dispersed in a second binder resin dissolved in a solvent, the second binder resin being a thermosetting resin to be heat-cured at a temperature lower than a thermosetting temperature of the first binder resin; step (3) of removing the solvent of the electrode paste, followed by heat-curing of the second binder resin to form an electrode layer; and step (4) of supporting the resistor layer and the electrode layer by the substrate after the transfer sheet is removed so that the resistor layer is exposed at the surface of the substrate.

In addition, in step (3) described above, the second binder resin is preferably heat-cured at a temperature lower than a glass transition temperature of the cured first binder resin contained in the resistor layer.

The solvent dissolving the first binder resin is preferably different from that dissolving the second binder resin.

For example, when the solvent used for the electrode paste is a solvent in which the first binder resin of the resistor paste is not easily dissolved, the resin of the resistor layer is not dissolved in the solvent used for the electrode paste in applying the electrode paste onto the resistor layer, and hence the powdered metal is also prevented from oozing into the resistor layer.

In the case described above, the first binder resin is preferably at least one selected from the group consisting of a thermosetting polyimide, a thermosetting poly(ether ketone), and a thermosetting bismaleimide, and the second binder resin is preferably at least one selected from the group consisting of a phenolic resin, an epoxy resin, and a melamine resin.

The powdered metal may comprise powdered silver, the powdered conductive material may comprise powdered carbon, and the electrode layer is preferably covered with the resistor layer after the transfer sheet is removed.

In addition, the solvent dissolving the first binder resin is preferably at least one solvent selected from the group consisting of methyl carbitol, ethyl carbitol, butyl carbitol, and methyl triglyme, or a mixed solvent containing one of the above solvents and α-terpineol. In addition, the solvent dissolving the second binder resin is preferably at least one solvent selected from the group consisting of acetic acid carbitol, methyl carbitol, ethyl carbitol, butyl carbitol, and methyl triglyme.

DESCRIPTION OF THE PREFERRED EMBODIMENTS

Figure 1:
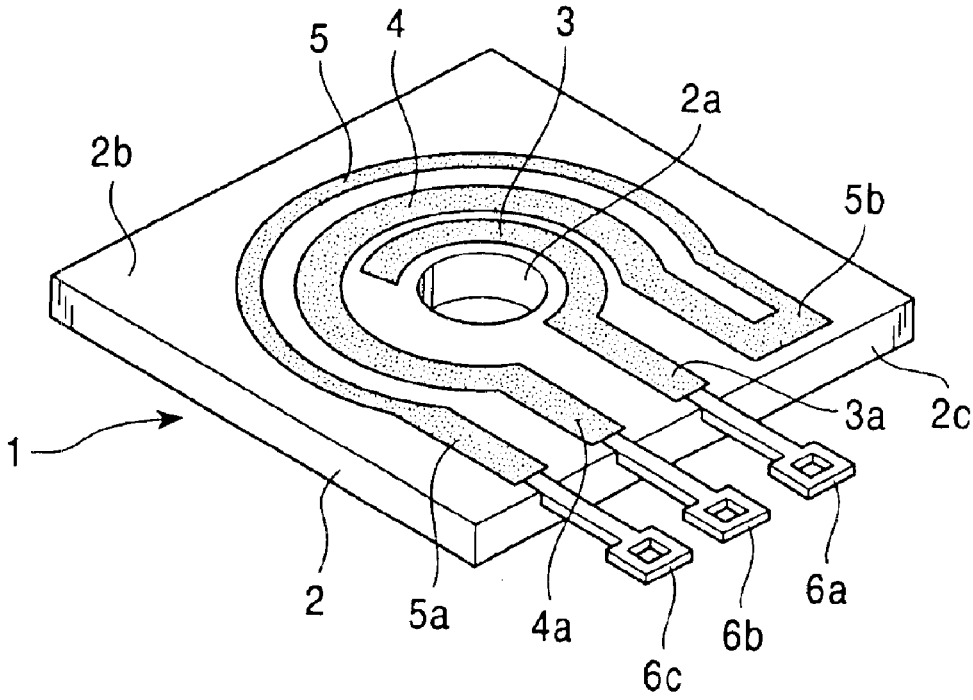
FIG. 1 is a perspective view showing a resistor substrate according to the present invention.
Figure 2:
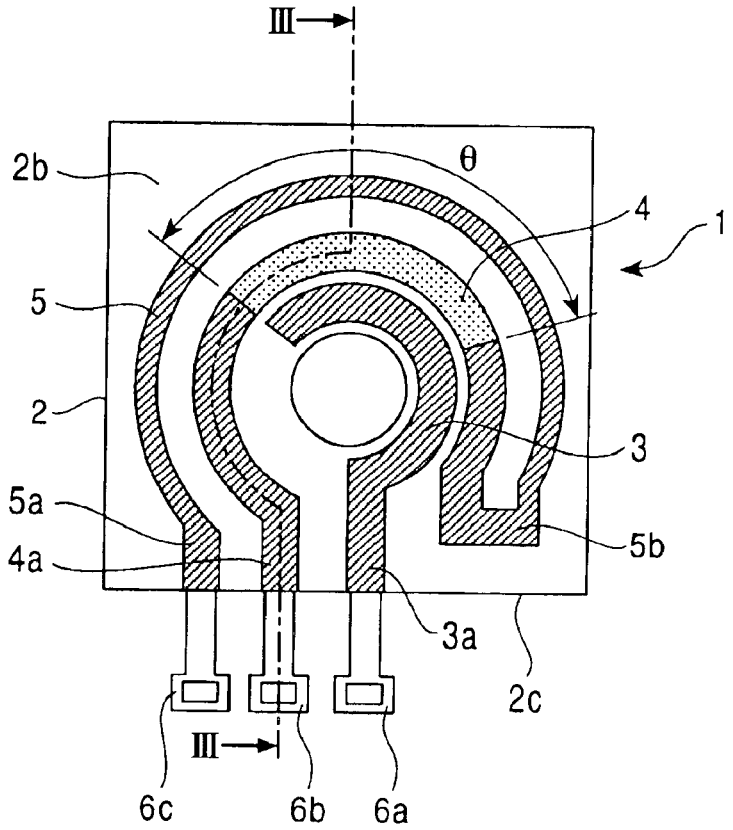
FIG. 2 is a plan view of the resistor substrate shown in FIG. 1.
Figure 3:
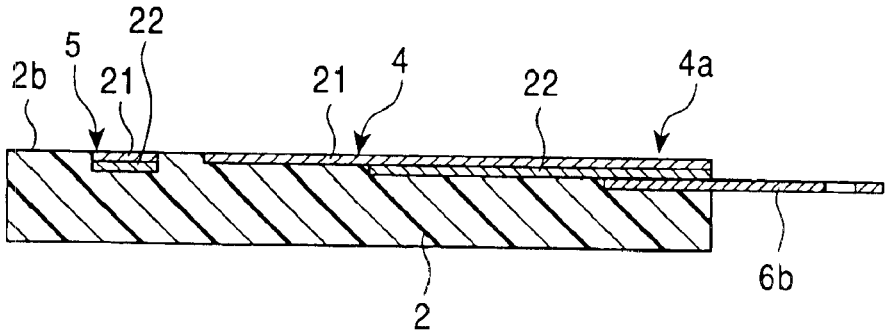
FIG. 3 is a cross-sectional view of the resistor substrate taken along the line III—III in FIG. 2.

FIG. 1 is a perspective view showing a resistor substrate, which is used for a variable resistor, of an embodiment according to the present invention, FIG. 2 is a plan view of the resistor substrate shown in FIG. 1, and FIG. 3 is a cross-sectional view of the resistor substrate taken along the line III—III in FIG. 2.

A resistor substrate 1 shown in FIG. 1 has an insulating molded base 2 formed of an epoxy resin or the like. At the center of this molded base 2, a circular opening portion 2*a* is formed in which a sliding contact (not shown) is fitted. In addition, on a surface 2*b* of the molded base 2 is formed a common pattern 3, a resistance detection pattern 4, and an auxiliary pattern 5. The primary part of each pattern mentioned above is formed to have a ring shape concentric with respect to the center of the opening portion 2*a*. A lead pattern 3*a* connected to the common pattern 3 extends to an end 2*c* of the molded base 2, and a lead pattern 4*a* connected to the resistance detection pattern 4 and a lead pattern 5*a* connected to the auxiliary pattern 5 both extend to the end 2*c*.

Terminals 6*a*, 6*b*, and 6*c* made of a conductive metal material protrude from the end 2*c* of the molded base 2, the terminal 6*a* overlaps the lead pattern 3*a* for electrical conduction, and the terminal 6*b* and 6*c* overlap the lead pattern 4*a* and 5*a*, respectively, for electrical conduction.

In addition, the resistance detection pattern 4 and the auxiliary pattern 5 are connected to each other in series with a connection pattern 5*b* provided therebetween. The auxiliary pattern 5 is a connection pattern for connecting one end of the resistance detection pattern 4 to the terminal 6*c*.

FIG. 3 is a cross-sectional view of the resistor substrate 1 taken along the line III—III in FIG. 2, in which a part of the resistance detection pattern 4 and the lead pattern 4*a* thereof, and a part of the auxiliary pattern 5 are shown. As shown in FIG. 3, there are a region which is formed only of a resistor layer 21 and a region which is formed of the resistor layer 21 provided on an electrode layer 22 disposed in the substrate, and a region which is formed only of the electrode layer 22 is not present.

In FIG. 2, for the convenience of illustration, the region which is formed only of the resistor layer 21 is shown by dots, and the region in which the resistor layer 21 is provided on the electrode layer 22 is shown by hatched lines. In the entire regions of the common pattern 3 and the lead pattern 3*a* thereof, the resistor layer 21 is provided on the electrode layer 22. As for the resistance detection pattern 4, a region indicated by an angle θ is formed only of the resistor layer 21, and the two end portions thereof and the lead pattern 4*a* are each formed of the resistor layer 21 and the electrode layer 22 provided thereunder. In addition, the entire auxiliary pattern 5 including the lead pattern 5*a* and the connection pattern 5*b* is formed of the resistor layer 21 and the electrode layer 22 provided thereunder.

That is, the region of the resistance detection pattern 4 indicated by the angle θ is formed only of the resistor layer 21 so as to detect the change in resistance in accordance with the sliding position of the sliding contact, and the other regions are each formed of the electrode layer 22 and each have the structure in which the electrode layer 22 is covered with the resistor layer 21 so as not to be exposed at the surface 2*b*.

The terminals 6*a*, 6*b*, and 6*c* are embedded in the molded base 2 and bonded to the respective electrode layers 22, which are formed in the substrate, at the lead patterns 3*a*, 4*a*, and 5*a*, respectively, with adhesive layers containing silver (not shown).

A rotor is fitted in the opening portion 2*a*, and the conductive sliding contact provided for this rotor slides on the surfaces of the common pattern 3 and the resistance detection pattern 4. As a result, between the terminals 6*a* and 6*b*, and between the terminals 6*a* and 6*c*, the change in resistance can be detected in accordance with the sliding position of the sliding contact.

The resistor layer 21 is formed of powdered carbon (at least one of carbon black, graphite, and carbon fiber) as a powdered conductive material dispersed in a thermosetting resin, and the electrode layer 22 is formed of powdered silver as a powdered metal dispersed in a thermosetting resin. In addition, the resistivity of the electrode layer 22 is sufficiently lower than that of the resistor layer 21. In addition to the powdered silver, for example, the powdered metal contained in the electrode layer 22 may be powdered gold, powdered copper, powdered platinum, powdered Ag—Pd, or powdered nickel. Alternatively, the mixture of the powdered metals mentioned above may also be used.

A thermosetting temperature of the resin of the electrode layer 22 is lower than that of the resistor layer 21 and is lower than a glass transition temperature thereof. The difference in thermosetting temperature between the resins of the resistor layer 21 and the electrode layer 22 is preferably 30° C. or more.

In the case in which there is the difference in thermosetting temperature between the resins as described above, when a manufacturing process is used in which after the resistor layers 21 are first heat-cured, the electrode layers 22 are patterned on the resistor layers 21, followed by heat-curing of the electrode layers 22, as described later, the resin of the resistor layers 21 cured already is not softened, and hence the powdered silver dispersed in the electrode layers 22 is unlikely to ooze and diffuse into the resistor layers 21.

In addition, when a manufacturing process is used in which a resistor paste forming the resistor layers 21 is patterned and dried, an electrode paste forming the electrode layers 22 is patterned on the resistor layers 21 and dried, and the resins of the two types of layers are heat-cured in the same heating step, a resin of the electrode layers 22 having a lower thermosetting temperature is first heat-cured, and hence the powdered silver dispersed in the electrode layers 22 is also unlikely to ooze and diffuse into the resistor layers 21.

Accordingly, in the regions in which the resistor layers 21 are provided on the electrode layers 22, which are shown by hatched lines in FIG. 2, the powdered silver is unlikely to diffuse into the resistor layers 21 and is not exposed at the pattern surfaces. Hence, the sliding contact slides on the surfaces of the resistor layers 21 each formed of the resin and the carbon, and in the region of the common pattern 3, the sliding contact does not slide on the powdered silver, thereby increasing the sliding life as a variable resistor.

Hereinafter, a method for manufacturing the resistor substrate 1 will be described.

(First Step: Formation of Resistor Layer)

A resistor paste is formed by dissolving 64 to 74 volume percent of a first binder resin in a first solvent, followed by mixing 10 to 20 volume percent of carbon black and 16 volume percent of carbon fiber (pulverized carbon fiber having a diameter of approximately 3 μm) with the resultant solution (the total of the first binder resin, the carbon black, and the carbon fiber except the solvent is 100 volume percent).

A transfer sheet 30 (see FIG. 4) made of brass is prepared, and by using a stainless steel-made mask having a pattern (the entire pattern including the regions indicated by the dots and the hatched lines in FIG. 2) for the resistor layers 21, the resistor paste is screen-printed on the surface of the transfer sheet 30.

After the screen printing, the resistor paste layers thus formed are dried at 200° C. for 30 minutes in a firing furnace so that the first solvent is removed by evaporation.

Next, in the same firing furnace, heating is performed at 260° C. for 30 minutes, followed by heating in the same firing furnace at 380° C. for 70 minutes. By this two-stage heat treatment, the first binder resin is cross-linked in a three-dimensional manner, and as a result, the resistor layers 21 each containing the carbon black and the carbon fiber are formed.

As described above, after the drying, when the two-stage heat treatment (including a plurality of steps) is performed by increasing the temperature in a stepwise manner, an internal stress generated in the resin during heat-curing can be reduced, and hence the residual strain can be reduced.

As the first solvent described above, for example, there may be mentioned at least one solvent selected from the group consisting of methyl carbitol (diethylene glycol monomethyl ether), ethyl carbitol (diethylene glycol monoethyl ether), butyl carbitol (diethylene glycol monobutyl ether), and methyl triglyme, or a mixed solvent composed of one of the solvents mentioned above and α-terpineol.

Among those mentioned above, in order to use a different solvent from a second solvent described later, a mixed solvent composed of a carbitol derivative and α-terpineol is preferably used.

As the first binder resin described above, a resin having a thermosetting temperature of approximately 250 to 380° C. is preferable, and for example, at least one of a thermosetting polyimide (a thermosetting temperature of 250 to 380° C. and a glass transition temperature Tg of 300 to 350° C.), a thermosetting poly(ether ketone) (PEK resin) (a thermosetting temperature of 250 to 380° C. and a glass transition temperature Tg of approximately 350° C.), and a thermosetting bismaleimide (a thermosetting temperature of approximately 300° C. and a glass transition temperature Tg of approximately 250 to 300° C.) may be used.

(Second Step: Formation of Electrode Layer)

As described above, onto the resistor layers 21 formed by heat-curing of the first binder resin, an electrode paste (conductive paste) is applied to form layers by screen printing.

The electrode paste is formed by mixing 10 to 50 volume percent of powdered silver and 50 to 90 volume percent of a second binder resin with the second solvent (the total of the powdered silver and the second binder resin except the solvent is 100 volume percent).

With a mask having a pattern forming the region indicated by the hatched lines shown in FIG. 2, the transfer sheet 30 and the resistor layers 21 are covered, and the electrode paste is patterned on the surfaces of the resistor layers 21.

By heating at 200° C. for 30 minutes in a firing furnace, the second solvent in the electrode paste is removed by evaporation, and the second binder resin is also cross-linked in a three dimensional manner, thereby forming the electrode layers 22 containing the powdered silver in the resin.

Figure 4A:
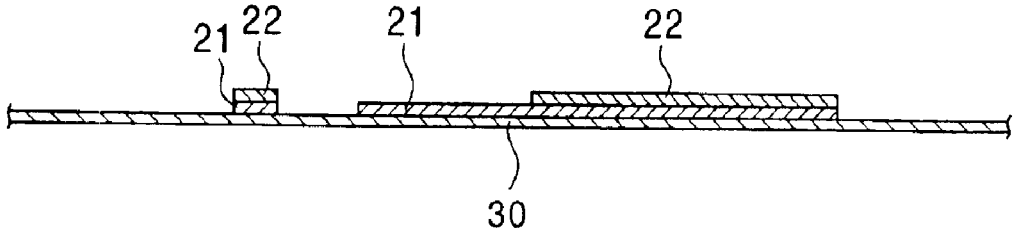
FIG. 4A is a cross-sectional view showing the structure in which resistor layers and electrode layers formed thereon are provided on a transfer sheet.

FIG. 4A is a cross-sectional view showing the electrode layers 22 provided on the resistor layers 21 formed on the surface of the transfer sheet 30.

As the second solvent described above, at least one of acetic acid carbitol, methyl carbitol, ethyl carbitol, butyl carbitol, and methyl triglyme is used.

In addition, as the second binder resin, for example, a resin may be used having a thermosetting temperature lower than the thermosetting temperature and the glass transition temperature Tg of the first binder resin, and for example, at least one of a phenolic resin, an epoxy resin, or a melamine resin, having a thermosetting temperature of 200 to 220° C., may be used.

(Third Step: Formation of Terminal Adhesive Layer)

As shown in FIG. 4A, after the electrode layers 22 are formed on the resistor layers 21 provided on the transfer sheet 30, terminal adhesion layers (conductive adhesion layers), not shown in the figure, are formed on the surfaces of the electrode layers 22 at the lead patterns 3*a*, 4*a*, and 5*a*.

In this step, layers of a terminal adhesion paste are formed on the surfaces of the electrode layers 22 by screen printing, and drying is performed at 80° C. for 10 minutes in the firing furnace described above so as to remove a solvent in the terminal adhesion paste by evaporation, thereby forming the terminal adhesion layers. For example, the terminal adhesion paste is formed by mixing 20 volume percent of powdered silver, 20 volume percent of a phenolic resin, and 60 volume percent of an epoxy resin with a solvent such as acetic acid carbitol (the total except the solvent is 100 volume percent).

(Fourth Step: Molding and Transfer)

Figure 4B:
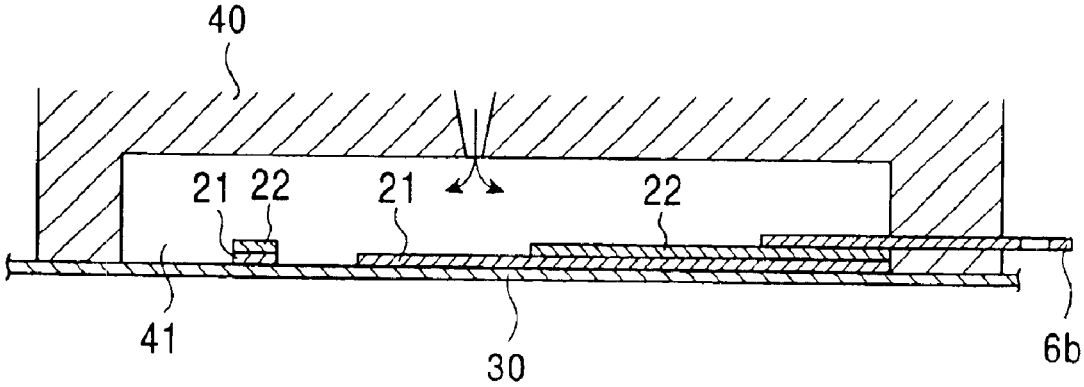
FIG. 4B is a cross-sectional view showing a step of forming a substrate.

As shown in FIG. 4B, the transfer sheet 30 is covered with a specialized mold 40. In this step, the terminals 6*a*, 6*b*, and 6*c* are placed on the surfaces of the electrode layers 22, at the lead patterns 3*a*, 4*a*, and 5*a*, respectively, with the terminal adhesion layers provided therebetween. Subsequently, a molten epoxy resin is injected into a cavity 41 of the mold 40. The temperature of the epoxy resin at this stage is preferably lower than the glass transition temperature Tg of the cured resin in the resistor layers 21 and that of the cured resin in the electrode layers 22, such as 200° C.

When the molten epoxy resin is injected into the cavity 41, the mixture of the phenolic resin and the epoxy resin forming the terminal adhesion layers is heat-cured by heat of the molten epoxy resin thus injected, and hence the terminals 6*a*, 6*b*, and 6*c* are adhered to the surfaces of the electrode layers 22 at the lead patterns 3*a*, 4*a*, and 5*a*, respectively.

After the epoxy resin thus injected is heat-cured, the mold 40 is then cooled to room temperature in the air, thereby forming the molded base 2. The molded base 2 thus formed is recovered from the mold 40, and the transfer sheet 30 is removed, thereby forming the resistor substrate 1.

According to this manufacturing method, after the resin of the resistor layers 21 is first heat-cured, the resin of the electrode layers 22 is heat-cured, and as the binder resin of the electrode layers 22, a resin is used having a thermosetting temperature lower than the thermosetting temperature and the glass transition temperature of the resin of the resistor layers 21. Hence, the powdered silver in the electrode layers 22 is prevented from oozing into the resistor layers 21.

In addition, since the first solvent used for forming the resistor layers 21 and the second solvent used for forming the electrode layers 22 are different from each other, and as the second solvent, a solvent in which the cured resin of the resistor layers 21 is not easily dissolved is used as described above, the powdered silver can be more efficiently prevented from oozing into the resistor layers 21.

Furthermore, in addition to the rotary variable resistor as shown in FIGS. 1 and 2, the resistor substrate of the present invention can be applied to a linear sliding variable resistor in which the sliding contact linearly slides, other resistance sensors, and the like.

As has thus been described, according to the present invention, the structure is formed in which the electrode layers are covered with the resistor layers, the powdered metal contained in the electrode layers is unlikely to ooze into the resistor layers, and the metal can be prevented from being exposed at the surface of the resistor layers. Hence, various problems (corrosion of the powdered metal, migration of silver, and the like) caused by the exposure of the powdered metal at the surface can be prevented.

What is claimed is:

1. A resistor substrate comprising: a resistor layer containing a powdered conductive material which is dispersed in a heat-cured resin; and an electrode layer containing powdered metal which is dispersed in a heat-cured resin, in which the resistor layer is exposed at the topmost surface of the resistor substrate, the electrode layer is provided under the resistor layer, and the resistor layer and the electrode layer are supported by the substrate, wherein the resin of the electrode layer has a thermosetting temperature lower than that of the resin of the resistor layer, and wherein the thermosetting temperature of the resin of the resistor layer is different from that of the resin of the electrode layer by 30° C. or more.

2. The resistor substrate according to claim 1, wherein the thermosetting temperature of the resin of the electrode layer is lower than a glass transition temperature of the resin of the resistor layer.

3. The resistor substrate according to claim 1, wherein the resin of the resistor layer is at least one selected from the group consisting of a thermosetting polyimide, a thermosetting poly(ether ketone), and a thermosetting bismaleimide, and the resin of the electrode layer is at least one selected from the group consisting of a phenolic resin, an epoxy resin, and a melamine resin.

4. A resistor substrate comprising: a resistor layer containing a powdered conductive material which is dispersed in a heat-cured resin; and an electrode layer containing a powdered metal which is dispersed in a heat-cured resin, in which the resistor layer is exposed at the topmost surface of the resistor substrate, the electrode layer is provided under the resistor layer, and the resistor layer and the electrode layer are supported by the substrate, wherein the resin of the electrode layer has a thermosetting temperature lower than that of the resin of the resistor layer; and wherein the thermosetting temperature of the resin of the electrode layer is lower than a glass transition temperature of the resin of the resistor layer.

5. A resistor substrate comprising: a resistor layer containing a powdered conductive material which is dispersed in a heat-cured resin; and an electrode layer containing a powdered metal which is dispersed in a heat-cured resin, in which the resistor layer is exposed at the topmost surface of the resistor substrate, the electrode layer is provided under the resistor layer, and the resistor layer and the electrode layer are supported by the substrate, wherein the resin of the electrode layer has a thermosetting temperature lower than that of the resin of the resistor layer, and wherein the resin of the resistor layer is at least one selected from the group consisting of a thermosetting polyimide, a thermosetting poly(ether ketone), and a thermosetting bismaleimide, and the resin of the electrode layer is at least one selected from the group consisting of a phenolic resin, an epoxy resin, and a melamine resin.

* * * * *